US005323865A

United States Patent [19]

Isbell et al.

[11] Patent Number: 5,323,865

[45] Date of Patent: Jun. 28, 1994

[54] EARTH-BORING BIT WITH AN ADVANTAGEOUS INSERT CUTTING STRUCTURE

[75] Inventors: Matthew R. Isbell; Rudolf C. O. Pessier, both of Houston; Robert E. Grimes, Cypress, all of Tex.

[73] Assignee: Baker Hughes Incorporated, Houston, Tex.

[21] Appl. No.: 992,869

[22] Filed: Dec. 17, 1992

Related U.S. Application Data

[63] Continuation-in-part of Ser. No. 949,660, Sep. 23, 1992.

[51] Int. Cl.[5] ..... E21B 10/00

[52] U.S. Cl. ..... 175/378; 175/420.1

[58] Field of Search ..... 175/331, 378, 376, 401, 175/420.1, 426, 430, 431

[56] References Cited

U.S. PATENT DOCUMENTS

| | | | |
|---|---|---|---|
| 1,896,251 | 2/1933 | Scott . | |
| 2,333,746 | 11/1943 | Scott et al. | 255/71 |
| 2,363,202 | 11/1944 | Scott | 255/71 |
| 2,527,838 | 10/1950 | Morlan et al. | 255/71 |
| 2,533,257 | 12/1950 | Woods et al. | 255/71 |
| 2,533,258 | 12/1950 | Morlan et al. | 255/71 |
| 2,533,259 | 12/1950 | Woods et al. | 255/71 |
| 2,533,260 | 12/1950 | Woods et al. | 255/71 |
| 2,678,875 | 8/1954 | Morlan et al. | 355/346 |
| 2,774,570 | 12/1956 | Cunningham | 255/347 |
| 2,774,571 | 12/1956 | Morlan | 255/347 |
| 2,804,282 | 8/1957 | Spengler, Jr. | 255/345 |
| 2,887,302 | 5/1959 | Garner | 255/349 |
| 2,907,551 | 10/1959 | Peter | 255/349 |
| 2,965,184 | 12/1960 | Morlan | 175/456 |
| 3,104,726 | 9/1963 | Davis | 175/331 |
| 3,442,342 | 5/1969 | McElya et al. | 175/374 |
| 3,946,820 | 3/1976 | Knapp | 175/341 |
| 4,140,189 | 2/1979 | Garner | 175/374 X |
| 4,148,368 | 4/1979 | Evans | 175/374 X |
| 4,343,371 | 8/1982 | Baker et al. | 175/376 X |
| 5,145,016 | 9/1992 | Estes | 175/426 X |
| 5,201,376 | 4/1993 | Williams | 175/374 |

OTHER PUBLICATIONS

Smith Int'l., Inc. Product Brochure, U.S.A. (circa 1991).

Rock Bit Int'l., Inc. Product Brochure, U.S.A. (circa 1992).

Dresser-Security, Product Brochure, U.S.A. (1992).

*Primary Examiner*—Ramon S. Britts

*Assistant Examiner*—Roger J. Schoeppel

*Attorney, Agent, or Firm*—Felsman, Bradley, Gunter & Dillon

[57] ABSTRACT

An earth-boring bit is provided with three cutters, at least one of the three cutters are provided with a heel cutting structure defined by a plurality of heel inserts having crests thereon, the heel inserts being disposed in at least one substantially circumferential heel row and the crests of the heel inserts being generally aligned traversely to the rotational axis of the cutter. At least another of the cutters is provided with a substantially circumferential row of axial inserts having crests thereon disposed proximally to the base of the cutter, the crests of the axial inserts being generally aligned with the axis of rotation of the cutter.

9 Claims, 2 Drawing Sheets

EARTH-BORING BIT WITH AN ADVANTAGEOUS INSERT CUTTING STRUCTURE

CROSS REFERENCE TO RELATED APPLICATION

This is a continuation-in-part of copending application Ser. No. 07/949,660, owned by a common assignee.

BACKGROUND OF THE INVENTION

FIELD OF THE INVENTION

This invention relates generally to earth-boring drill bits, and particularly to improved cutting structures for such bits of the hardmetal insert variety.

BACKGROUND INFORMATION

The success of rotary drilling enabled the discovery of deep oil and gas reservoirs. The rotary rock bit was an important invention that made rotary drilling economical. Only soft earthen formations could be commercially penetrated with the earlier drag bit, but the two cone rock bit, invented by Howard R. Hughes, U.S. Pat. No. 930,759, drilled the hard caprock at the Spindletop Field, near Beaumont, Texas, with relative ease. That venerable invention, within the first decade of this century, could drill a scant fraction of the depth and speed of the modern rotary rock bit. If the original Hughes bit drilled for hours, the modern bit drills for days. Modern bits sometimes drill for thousands of feet instead of merely a few feet. Many advances have contributed to the impressive improvement of rotary rock bits.

In drilling boreholes in earth formations by the rotary method, rotary rock bits fitted with one, two, or three rolling cutters, rotatably mounted thereon, are employed. The bit is secured to the lower end of a drill string that is rotated from the surface or by downhole motors or turbines. The cutters mounted on the bit roll upon the bottom of the borehole as the drill string is rotated, thereby engaging and disintegrating the formation material to be removed. The roller cutters are provided with teeth that are forced to penetrate and gouge the bottom of the borehole by weight from the drill string.

The cuttings from the bottom and sides of the well are washed away by drilling fluid that is pumped down from the surface through the hollow, rotating drill string, and are carried in suspension in the drilling fluid to the surface. The form and location of the teeth upon the cutters have been found to be extremely important to the successful operation of the bit. Certain aspects of the design of the cutters become particularly important if the bit is to penetrate deeply into a formation to effectively strain and induce failure in more plastically behaving rock formations such as shales, siltstones, and chalks.

A significant development in the history of rolling cone earth-boring bits was the introduction of the tungsten carbide insert (TCI) bit by Hughes Tool Company in 1951. In these TCI bits, the cutting teeth are provided by securing, by press-fit or otherwise, inserts or buttons of tungsten carbide, or other hardmetals, to the surface or shell of the cutters. The original TCI bit is disclosed in U.S. Pat. No. 2,687,875, Aug. 31, 1954 to Morlan et al These TCI bits, because of their excellent wear resistance properties, substantially increased the penetration rates and operating lives of earth-boring bits. Subsequent improvements in TCI bit technology include the provision of bits with chisel-shaped inserts having crests that increase the ability of the teeth to penetrate and disintegrate formation material. Such inserts are disclosed in U.S. Pat. No. 3,442,342, May 6, 1969, to McElya et al.

In drilling shales and siltstones, which are the dominant lithologies in oil well drilling, and other earthen formations, two problems frequently arise. One problem, known as "tracking," occurs when the inserts of a cutter fall in the same indentation that was made on the previous revolution of the bit. When this occurs, the inserts of the cutters on the bit are said to "track." Tracking causes the formation of a pattern of smooth hills and valleys, known as "rock teeth," on the bottom of the borehole. Tracking thus results in a sculptured drilling surface that closely matches the pattern of the inserts of the cutters, making it more difficult for the inserts to reach the virgin rock at the bottom of the valleys. The sculptured pattern also tends to redistribute the weight on the bit from the tips of the inserts to the cutter shell surface, which impedes deep penetration and leads to inefficient material fragmentation, and often to damage to the bit and bit bearings.

The other problem frequently encountered in drilling shales, and other soft earthen formations, is known as "bailing." Balling occurs when formation material becomes lodged between the inserts on the cutter of the bit. Balling, like tracking, prevents the inserts of the cutter from penetrating to full depth, thus resulting in inefficient and costly drilling. Balling also prevents the force on the tips of the inserts from reaching a level sufficient to fracture rock.

The characteristics of both tracking and balling are well-recognized, but generally are treated as independent problems. Balling is more likely to occur between closely spaced, low-projection inserts and such inserts are severely limited in their ability to penetrate the formation deeply. Therefore, TCI bits designed for soft-formation drilling typically have relatively high-projection and widely spaced inserts. However, high-projection and widely spaced inserts are prone to tracking. Additionally, because the teeth of TCI bits are formed of materials having excellent hardness and abrasion-resistance, but generally low toughness, the protrusion of such teeth from the surface of the cutter is necessarily limited to avoid excessive fracture of the inserts. Therefore, TCI bits are more susceptible to balling and its deleterious effects.

One requirement for earth-boring bits of the rolling cone variety is that the bits must maintain a relatively constant diameter of gage of the borehole during drilling operation. If the gage is not maintained at a relatively constant dimension, i.e. the borehole diameter becomes diminished as drilling depth and bit wear increase, the bit may draw more power and becomes a less efficient drilling tool. An undergage borehole is wasteful of rotary cutting energy and shortens bit life, leading to more time-consuming and expensive drilling. To assist in maintenance of the gage of the borehole during drilling, conventional insert bits typically employ a combination of a gage row of substantially flat-topped, wear-protecting hardmetal inserts on the gage surface of the cutters, and a heel row of protruding, generally ovoid or wedge-shaped inserts located on the cutter to disintegrate formation material at the intersection of the borehole sidewall and the borehole bottom. In these conventional bits, the crests of the wedge-shaped heel inserts are aligned with the axes of rotation of the cutters and are referred to as "axial" inserts. Such insert cutting structures are disclosed in U.S. Pat. No. 2,774,570, Dec. 18, 1956 to Cunningham and U.S. No. 2,774,571, Dec. 18, 1956, to Morlan.

There exists a need, therefore, to provide an earth-boring bit of the TCI variety having a cutting structure designed to penetrate relatively soft earthen formations rapidly by simultaneously minimizing the occurrence of both tracking and balling, and by maintaining a substantially constant gage during the operating life of the bit.

SUMMARY OF THE INVENTION

It is a general object of the present invention to provide an earth-boring bit of the rolling cone variety having improved ability to penetrate earthen formations. This and other objects of the present invention are accomplished by providing an earth-boring bit having a bit body, the bit body having at least two cutters mounted for rotation on a bearing shaft that depends from the bit body, and each cutter having a nose and a base. At least one of the cutters is provided with a heel cutting structure defined by a plurality of heel inserts having crests thereon, the heel inserts being disposed in at least one substantially circumferential heel row and the crests of the heel inserts being generally aligned transversely to the rotational axis of the cutter. At least another of the cutters includes a substantially circumferential row of axial inserts disposed proximally to the base of the cutter. The crests of the axial inserts are generally aligned with the rotational axis of the cutter.

According to a preferred embodiment of the invention, an earth-boring bit is provided with three cutters and two of the three cutters are provided with the heel cutting structure.

In another embodiment of the invention, each traversely aligned heel insert defines an inner insert surface and an outer insert surface, and at least the outer insert surface is formed of a super-hard, abrasion-resistant material, such as polycrystalline diamond or cubic boron nitride.

Other objects, features, and advantages of the present invention will be apparent to those skilled in the art with reference to the following drawings and detailed description of the preferred embodiment of the present invention.

DESCRIPTION OF THE PREFERRED EMBODIMENT

Figure 1:
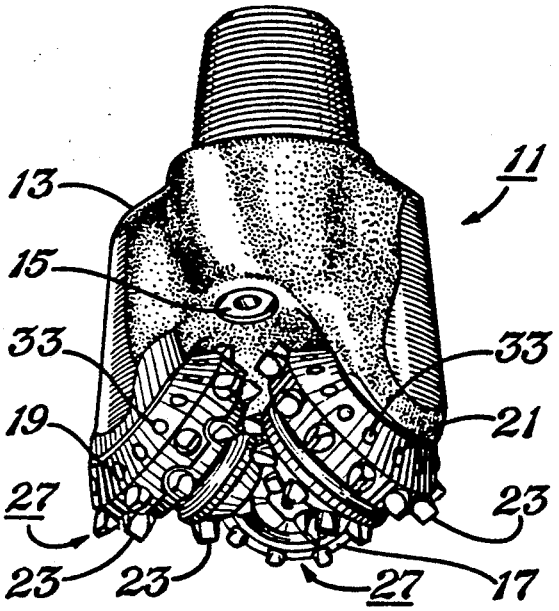
FIG. 1 is a perspective view of an earth-boring bit according to the present invention.

FIG. 1 illustrates an earth-boring bit 11 according to the present invention. Bit 11 is provided with a bit body 13, which is threaded at its upper extent for connection into a drillstring. Bit body 13 is provided with at least one nozzle 15, which sprays drilling fluid from within the drillstring to cool bit 11 and wash cuttings produced during drilling out of the borehole.

A plurality of cutters 17, 19, 21, in this case three, are mounted for rotation on cantilevered bearing shafts (not shown) depending from bit body 13. Cutters 17, 19, have noses and bases, and are provided with a plurality of teeth formed by press-fitting or otherwise securing inserts 23 into sockets formed in the surfaces of cutters 17, 19, 21. Inserts 23 may be formed of a variety of hard, abrasion-resistant materials, including, but not limited to, tungsten carbide. During drilling operation, cutters 17, 19, 21 roll over the bottom of the borehole being drilled while insert teeth 23 penetrate and disintegrate the formation.

Bit 11 is further provided with a heel cutting structure 27 according to the present invention. In the preferred embodiment illustrated, heel cutting structure 27 is provided on two cutters 17, 19, while third cutter 21 is provided with conventional axial inserts 23 in the heel region. Cutters 17, 19, 21 are further provided with a plurality of gage inserts 33 disposed in circumferential rows on the gage surfaces of cutters 17, 19, 21.

Figure 2:
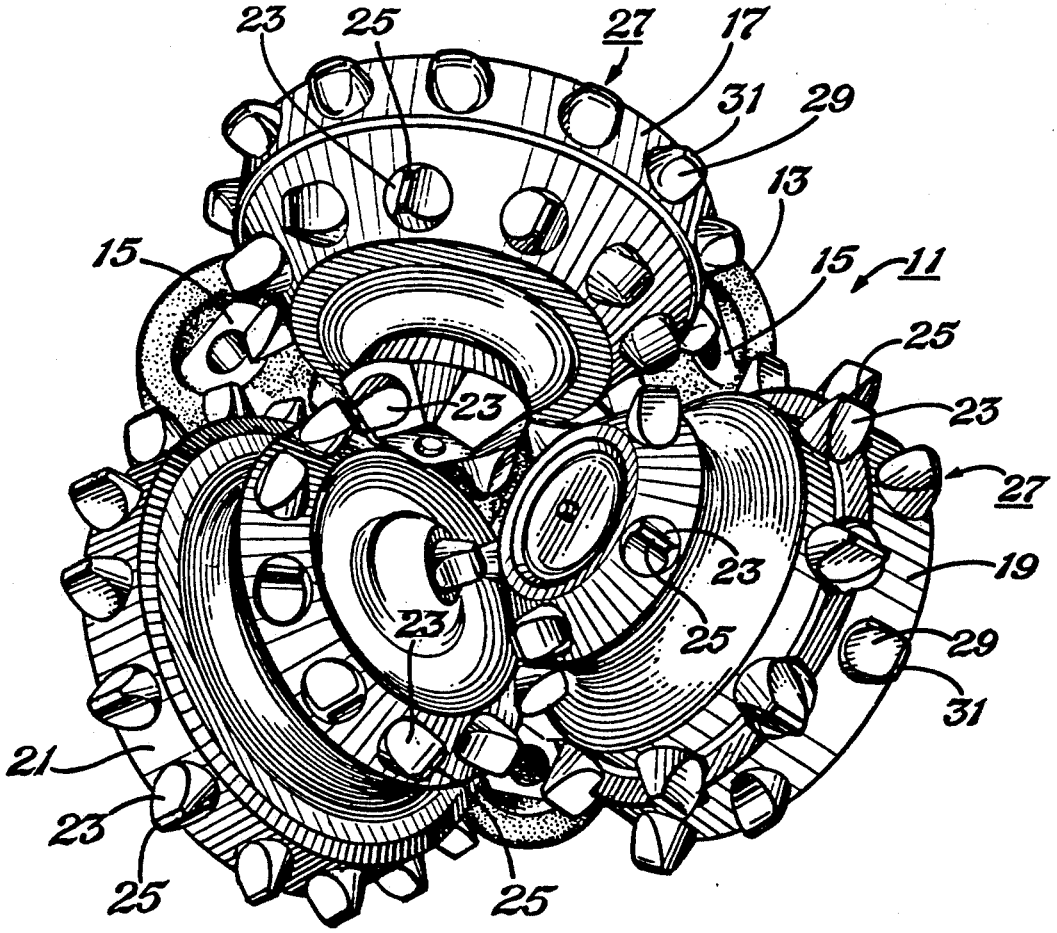
FIG. 2 is a perspective view, viewed from below looking upwardly, of the cutters of the earth-boring bit of FIG. 1.

With reference now to FIG. 2, a more detailed view of bit 11, viewed from below looking upwardly, is depicted. In this illustration, inserts 23 and heel cutting structure 27 can be more fully appreciated. All three cutters 17, 19, 21, are provided with inserts 23 arranged in a plurality of substantially circumferential rows. Inserts 23 are illustrated as chisel-shaped inserts, but could also be ovoid-shaped, ogive-shaped, or any other conventional shape. Chisel-shaped inserts 23 on the inner rows have their crests 25 generally aligned with the axes of rotation of cutters 17, 19, 21, and thus are referred to as "axial" inserts.

Cutter 21 is provided with, among other rows, a substantially circumferential heel row of axial inserts 23. Crests 25 of axial inserts in the heel row of cutter 21 are generally aligned with the axis of rotation of cutter 21. As will be described in greater detail with reference to the operation of the present invention, the heel row of axially crested inserts on cutter 21 cooperates with heel cutting structure 27 on cutters 17, 19 to improve the ability of bit 1 to penetrate earthen formations.

Heel cutting structure 27 comprises a plurality of heel inserts 29 having crests 31 thereon arranged in a substantially circumferential row proximal to the bases of cutters 17, 19. Crests 31 of heel inserts 29 are aligned generally transversely to the rotational axes of cutters 17, 19, and thus at right angles to crests 25 of the remainder of axial inserts 23.

Figure 3:
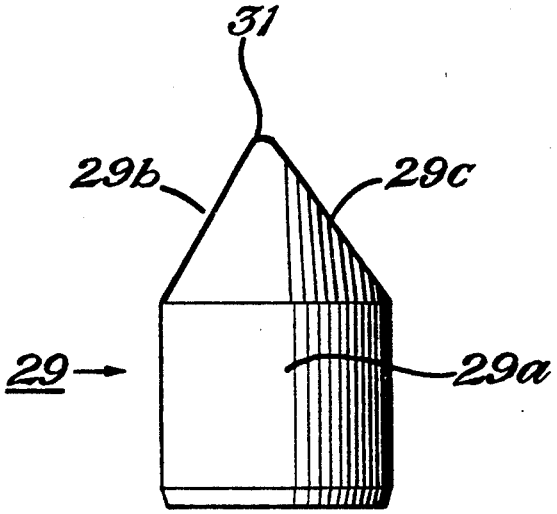
FIG. 3 is an elevation view of a chisel-shaped insert contemplated for use with the present invention.

Referring now to FIG. 3, a chisel-shaped heel insert 29 is illustrated. Chisel-shaped heel insert 29 shown is that employed in heel cutting structure 27 of earth-boring bit 1 according to the present invention illustrated in FIGS. 1 and 2. Chisel-shaped heel insert 29 includes a generally cylindrical insert body **29*a* which is provided at its upper extent with a pair of opposing insert surfaces 29*b* and 29*c*. Insert surfaces 29*b* and 29*c* converge to define crest 31. In the embodiment illustrated, insert surfaces 29*b*, 29*c* are generally planar or slightly convex outwardly. In other embodiments, insert surfaces 29*b*, 29*c*** may be concave inwardly.

Because insert 29 is secured to its cutter with its crest 31 aligned generally transversely to the rotational axis of the cutter, one of insert surfaces **29*b* is defined as an outer surface because it faces outwardly, toward the sidewall of the borehole being drilled. It follows, then, that opposing insert surface 29*c* is defined as an inner surface. Preferably, at least outer surface 29b is formed of a super-hard, abrasion-resistant material, such as polycrystalline diamond or cubic boron nitride, to increase the wear resistance of heel insert 29. Such a surface may be formed in a number of conventional manners. Provision of one of surfaces 29b, 29c with increased wear-resistant properties renders insert 29 self-sharpening, wherein the differential in wear rates between surfaces 29b, 29c maintains a sharp and well-defined insert crest 31 throughout the operating life of bit 11. Preferably, heel cutting structure 27 is provided on cutters having rows of axially crested teeth 23 closely adjacent the base of the cutter, e.g. cutters 17, 19; while the cutter with the next adjacent row of axially crested teeth 23 furthest from the base of the cutter is provided with axially crested teeth 23 proximal to the base of the cutter, i.e. cutter 21**.

Figure 4:
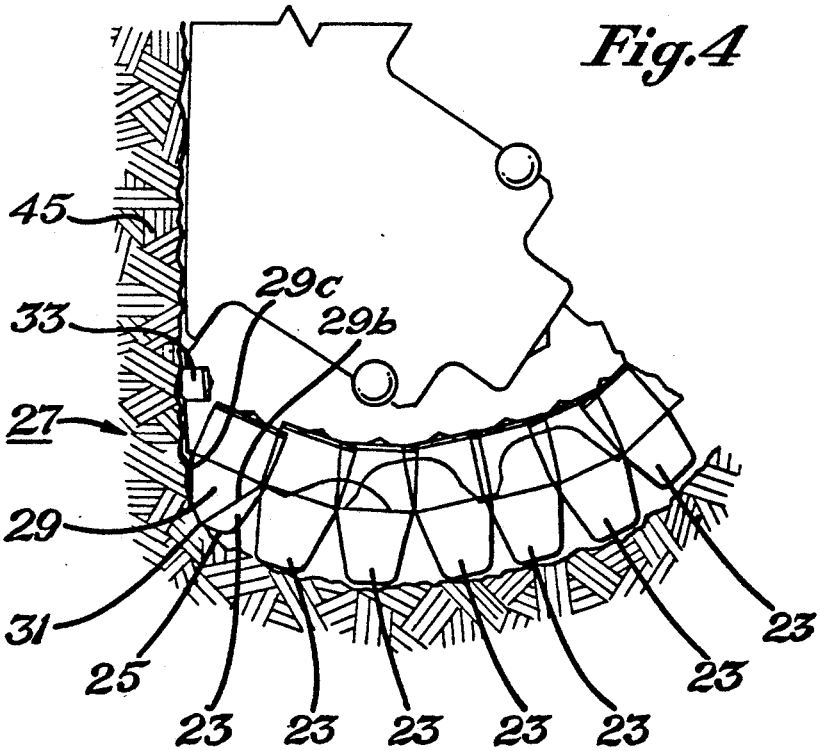
FIG. 4 is a fragmentary, enlarged section view of an earth-boring bit that schematically illustrates the cutting profile of an earth-boring bit according to the present invention defined by the cutters and teeth thereon relative to the borehole.

FIG. 4 is an enlarged, fragmentary section view of an earth-boring bit according to the present invention that schematically illustrates the cutting profile defined by such a bit relative to a borehole 45 being drilled. Illustrated is a schematic representation of the superimposition of the inner rows of teeth, defined by axial inserts 23, and heel cutting structure 27.

Outermost and adjacent the gage or sidewall outermost diameter of borehole 45, gage inserts 33 protect the gage surface of the cutters from abrasive wear resulting from contact with the sidewall of borehole 45. At the intersection of the sidewall and the bottom of borehole 45, heel inserts 29 on cutters 17, 19 engage the formation material along with axial inserts 31 of cutter 21. Preferably, and as illustrated, crests 31 of heel inserts 29 of heel cutting structure 27 protrude the same distance from the cutter surface as crests 25 of axial inserts 23. Inwardly from the intersection of the sidewall and bottom of borehole are the remainder of the inner rows of axial inserts 23.

Referring to FIGS. 1–4, the operation of earth-boring bit 1 according to the present invention will be described. The interfitting arrangement of heel inserts 29 and axial inserts 23 cooperate together to create an improved cutting action on the bottom and gage of the borehole 45. As the bit rotates, cutters 17, 19, 21 roll and slide over the bottom of borehole 45, permitting heel inserts 29 of heel cutting structure 27 and axial inserts 23 to engage, penetrate, and disintegrate borehole 45. Circumferential crests 31 of heel inserts 29 of heel cutting structure 27 circumscribe a relatively narrow path adjacent and overlapping the widely spaced impressions left by the remainder of the rows of axial inserts 23.

Heel inserts 29 with circumferentially aligned crests 31 can penetrate formation material more easily and "dice" nascent rock teeth between impressions left by adjacent axially crested inserts 23. These effects combine to provide a cutting structure that possesses increased ability to avoid tracking and balling conditions and results in more efficient and rapid penetration of formation material.

Furthermore, heel inserts 29 of heel cutting structure 27 very effectively kerf and scrape the gage or borehole sidewall, generating only relatively small quantities of undesirably fine cuttings, and cooperate with the remainder of heel and inner rows of axial inserts 23 to move cuttings away from the gage and toward the fluid nozzle (15 in FIG. 1), which promotes the ability of earth-boring bit 11 to maintain gage and wash formation cuttings up the borehole 45. Also, because outer insert surfaces 29b, of heel inserts are in engagement with the sidewall of borehole 45, a relatively large surface area is exposed to abrasive wear, and the wear resistance of heel cutting structure 27 is increased. Self-sharpening heel inserts 29, as described herein maintain sharp and well-defined crests 31 throughout the operating life of bit 11, thereby increasing the ability of heel cutting structure 27 to effectively kerf the gage of the borehole.

The earth-boring bit according to the present invention has a number of advantages. One advantage is the improved and increased rate of penetration of formation. Another advantage is that the bit has an improved ability to maintain the gage or diameter of the borehole being drilled through the gage-kerfing characteristics of the heel inserts of the heel cutting structure. This advantage provides a more consistent borehole diameter, and permits maintenance of high penetration rates over the life of the bit. Yet another advantage is that the bit runs cooler and longer because it is less prone to balling.

The invention has been described with reference to preferred embodiments thereof. Those skilled in the art will appreciate that the present invention is susceptible to variation and modification without departing from the scope and spirit thereof.

We claim:

1. An earth-boring bit having an improved rate of penetration into earthen formations, the earth-boring bit comprising:

a bit body;

at least two cutters, each cutter mounted for rotation on a bearing shaft depending from the bit body, each cutter including a nose and a base a plurality of inserts secured to each cutter, the inserts arranged in substantially circumferential rows on each cutter, a first cutter having a substantially circumferential row of axial inserts having crests thereon disposed proximally to the base of the first of the cutters, the crests of the axial inserts being generally aligned with the axis of rotation of the first cutter; and a heel cutting structure defined by a plurality of heel inserts having crests thereon disposed in at least one substantially circumferential heel row proximal to the base of at least a second cutter, the crests of the heel inserts being aligned generally transversely to the axis of rotation of the second cutter.

2. The earth-boring bit according to claim 1 wherein the heel inserts are chisel-shaped inserts.

3. The earth-boring bit according to claim 1 further including three cutters, two of the three cutters being provided with the heel cutting structure.

4. The earth-boring bit according to claim 1 wherein the heel inserts have an inner insert surface and an outer insert surface, and at least the outer surface is formed of super-hard, abrasion-resistant material.

5. An earth-boring bit having an improved rate of penetration into earthen formations, the earth-boring bit comprising:

a bit body;

three cutters, each cutter mounted for rotation on a bearing shaft depending from the bit body, each cutter including a nose and a base;

a plurality of inserts secured to each cutter, the inserts arranged in substantially circumferential rows on each cutter, a first of the cutters having a substantially circumferential row of axial inserts having crests thereon disposed proximally to the base of the first cutter, the crests of the axial inserts being generally aligned with the axis of rotation of the first cutter; and a heel cutting structure defined by a plurality of heel inserts having crests thereon, the heel inserts disposed in at least one substantially circumferential heel row proximal to the base of a second and third of the cutters, the crests of the heel row inserts being aligned generally transversely to the rotational axis of the second cutter.

6. The earth-boring bit according to claim 5 wherein the heel inserts are chisel-shaped inserts.

7. The earth-boring bit according to claim 5 wherein the heel inserts have an inner surface and an outer surface, and at least the outer surface is formed of superhard, abrasion-resistant material.

8. An earth-boring bit having an improved rate of penetration into earthen formations, the earth-boring bit comprising:

a bit body;

three cutters, each cutter mounted for rotation on a bearing shaft depending from the bit body, each cutter including a nose and a base;

a plurality of inserts secured to each cutter, the inserts arranged in substantially circumferential rows on each cutter, a first cutter including a substantially circumferential row of axial inserts having crests thereon disposed proximally to the base of the first cutter, the crests of the axial inserts being generally aligned with the axis of rotation of the first cutter;

a first heel cutting structure on a second cutter, the first heel cutting structure defined by a plurality of heel inserts having crests thereon, the heel inserts disposed in a substantially circumferential row proximal to the base of the second cutter, the crests of the heel inserts being generally aligned transversely to the rotational axis of the second cutter; and a second heel cutting structure on a third cutter, the second heel cutting structure defined by a plurality of heel inserts having crests thereon, the heel inserts disposed in at least one substantially circumferential row proximal to the base of the third cutter, the crests of the heel inserts being generally aligned transversely to the rotational axis of the third cutter.

9. The earth-boring bit according to claim 8 wherein each heel insert has an inner surface and an outer surface, at least the outer surface being formed of superhard, abrasion-resistant material.

* * * * *